US008518864B2

(12) United States Patent
Nagumo et al.

(10) Patent No.: US 8,518,864 B2
(45) Date of Patent: Aug. 27, 2013

(54) GREASE COMPOSITION FOR CONSTANT-VELOCITY JOINTS AND CONSTANT-VELOCITY JOINT ENCLOSING THE SAME

(75) Inventors: Daigo Nagumo, Fujisawa (JP); Yuji Onuki, Fujisawa (JP); Shinya Kondo, Fujisawa (JP); Shin Tomogami, Iwata (JP); Shinichi Takabe, Iwata (JP)

(73) Assignees: Kyodo Yushi Co., Ltd., Kanagawa (JP); NTN Corporation, Osaka (JP)

( * ) Notice: Subject to any disclaimer, the term of this patent is extended or adjusted under 35 U.S.C. 154(b) by 169 days.

(21) Appl. No.: 12/600,903

(22) PCT Filed: May 30, 2008

(86) PCT No.: PCT/JP2008/060002

§ 371 (c)(1),
(2), (4) Date: Nov. 19, 2009

(87) PCT Pub. No.: WO2008/146909

PCT Pub. Date: Dec. 4, 2008

(65) Prior Publication Data

US 2010/0173807 A1 Jul. 8, 2010

(30) Foreign Application Priority Data

May 30, 2007 (JP) ..... 2007-143704

(51) Int. Cl.

| | |
|---|---|
| ***C10M 137/10*** | (2006.01) |
| ***C10M 125/22*** | (2006.01) |
| ***C10M 125/24*** | (2006.01) |
| ***C10M 135/18*** | (2006.01) |
| ***C10M 133/20*** | (2006.01) |

(52) U.S. Cl.
USPC ..... 508/369; 508/559

(58) Field of Classification Search
USPC ..... 508/100, 328, 335, 365, 369, 371, 508/528, 555, 559
See application file for complete search history.

(56) References Cited

U.S. PATENT DOCUMENTS

| | | | | |
|---|---|---|---|---|
| 5,160,645 | A | 11/1992 | Okaniwa et al. | |
| 5,207,936 | A | 5/1993 | Anzai et al. | |
| 5,858,931 | A | 1/1999 | Tanaka et al. | |
| 5,952,273 | A * | 9/1999 | Suzuki et al. | 508/168 |
| 6,022,835 | A * | 2/2000 | Fletcher | 508/365 |
| 6,063,740 | A | 5/2000 | Kinoshita et al. | |
| 6,333,297 | B2 * | 12/2001 | Takabe | 508/364 |
| 6,432,888 | B1 * | 8/2002 | Komiya et al. | 508/364 |
| 2002/0013232 | A1 | 1/2002 | Kinoshita et al. | |
| 2004/0224859 | A1 | 11/2004 | Numazawa et al. | |
| 2005/0003970 | A1 * | 1/2005 | Ohmura et al. | 508/365 |

FOREIGN PATENT DOCUMENTS

| | | |
|---|---|---|
| CN | 1723268 A | 1/2006 |
| JP | 9-87649 | 3/1997 |
| JP | 2915611 | 4/1999 |
| JP | 2989311 | 10/1999 |
| JP | 2001-193751 | 7/2001 |
| JP | 2001-520301 | 10/2001 |
| JP | 2004-204218 | 7/2004 |
| KR | 10-1998-0080848 | 11/1998 |
| KR | 10-0497707 | 9/2005 |

OTHER PUBLICATIONS

Molyvan A avialable on or before Sep. 14, 1999.*
R.T. Vanderbilt Co. Lubricant Additives (Aug. 2006) (p. 18) (available online 2006).*
International Search Report for PCT/JP2008/060002, mailed Jun. 24, 2008.
Written Opinion of the International Searching Authority for PCT/JP2008/060002, mailed Jun. 24, 2008.
Extended European Search Report dated Mar. 7, 2011, issued in corresponding European Application No. 08777013.7-2104.
Korean Office Action dated Jun. 23 2011, issued in corresponding Korean Application No. KR 10-2009-7024491 with English translation.
Korean Decision to Grant issued for corresponding Korean Patent Application No. 10-0497707, dated Mar. 29, 2012.
Chinese Official Action issued for corresponding Chinese Patent Application No. 2012033100679530, dated Apr. 6, 2012.

* cited by examiner

*Primary Examiner* — Pamela H Weiss
(74) *Attorney, Agent, or Firm* — Nixon & Vanderhye P.C.

(57) ABSTRACT

A grease composition for constant-velocity joints which is inexpensive and which and which has an improved anti-flaking property without using materials which have environmental burdens, and a constant-velocity joint enclosing this grease are provided. A grease composition for constant-velocity joints comprising:
(a) a base oil,
(b) a diurea thickener,
(c) a zinc dialkyldithiophosphate,
(d) a sulfurized molybdenum dialkyldithiocarbamate,
(e) a zinc dialkyldithiocarbamate, and
(f) a sulfur-nitrogen extreme pressure additive
is provided.

4 Claims, No Drawings

GREASE COMPOSITION FOR CONSTANT-VELOCITY JOINTS AND CONSTANT-VELOCITY JOINT ENCLOSING THE SAME

This application is the U.S. national phase of International Application No. PCT/JP2008/060002 filed 30 May 2008, which designated the U.S. and claims priority to JP Application No. 2007-143704 filed 30 May 2007, the entire contents of each of which are hereby incorporated by reference.

TECHNICAL FIELD

The present invention relates to a grease composition for constant-velocity joints and a constant-velocity joint enclosing the same, particularly to a grease composition for constant-velocity joints suitably employed for slide-type constant-velocity joints or fixed-type constant-velocity joints and to a constant-velocity joint enclosing such a grease composition.

BACKGROUND ART

These days, in the automobile industry, the production of FF cars is increasing from the viewpoint of assuring weight reduction and passenger space. The production of 4WD cars is also increasing from the viewpoint of their functionality. Since these FF cars and 4WD cars transmit power and steering through front wheels, smooth power transmission is required even, for example, in the state that the front wheels are steered to the full lock position. Thus, the constant-velocity joint is indispensable as a component that transmits rotational motion of one axis to another axis at a constant velocity even when a crossing angle of the two axes which cross each other changes widely.

Among these constant-velocity joints, a ball-type constant-velocity joint has a structure in which a ball transmits torque as a rolling element. Flaking may take place in this structure because, during rotation, repetitive stress is applied to the ball and to the metal surface which the ball contacts due to a complex rolling and sliding motion under a high contact pressure.

In addition, higher output of recent engines has made the conditions of constant-velocity joint severer, and occurrence of flaking on the rolling surface of an outer race and an inner race and on the ball tends to be further accelerated. Therefore, the improvement of anti-flaking property is demanded.

As a grease composition for constant-velocity joints to overcome the above-described problems, a grease composition for constant-velocity joint containing a base oil, a urea thickener, sulfurized molybdenum dialkyldithiocarbamate, molybdenum disulfide, dialkyldithiophosphate, an oiliness agent comprising one or more vegetable oils is known (see, for example, Patent Document 1). However, these conventional grease compositions do not necessarily have enough anti-flaking property.

A grease composition for constant-velocity joints containing a base oil, a diurea thickener, a sulfurized molybdenum dialkyldithiocarbamate, a dialkyldithiophosphate, metal-free sulfur-phosphorus extreme pressure additive is also known (see, for example Patent Document 2). Although this grease composition exhibits an excellent anti-flaking property, the grease is not desirable in aspects of protecting global environment and of safety because it contains lead, which is heavy metal.

Patent Document 1 JP 2915611 B
Patent Document 1 JP 2989311 B

DISCLOSURE OF INVENTION

Problems to be Solved by the Invention

Although a certain anti-flaking property may be obtained when the above described molybdenum disulfide is used, the obtained grease is expensive and lacks versatility because of recent rising price of molybdenum.

Further, although an excellent anti-flaking property may be obtained by using lead dialkyldithiophosphate, the grease is not desirable in aspects of protecting global environment and of safety because it contains lead.

Therefore, an object of the present invention is to provide a grease composition for constant-velocity joints which is inexpensive and which has an improved anti-flaking property without using materials which have environmental burdens.

Another object of the present invention is to provide a constant-velocity joint enclosing the above-described grease composition.

Means for Solving the Problems

In order to develop the above-described grease composition for constant-velocity joints which has an improved anti-flaking property, the present inventors performed an anti-flaking property characterization by using SRV tester known as a frictional wear tester. As a result, the present inventors have discovered that there is a special relationship between the anti-flaking property of the constant-velocity joint and a wear status and a coefficient of friction of a ball and a plate under specific conditions using SRV tester. Further, the present inventors have investigated the above-mentioned relationships by various combinations of a urea grease used as a base grease and a variety of extreme pressure agents or the like.

As a result, the present inventor have discovered that a grease composition containing a diurea thickener, a base oil, zinc dialkyldithiophosphate, sulfurized molybdenum dialkyldithiocarbamate, zinc dialkyldithiocarbamate, and sulfur-nitrogen extreme pressure additive has extremely improved wear resistance and low frictional properties. Further, it has been discovered that, also in an endurance test using an actual constant-velocity joint, the grease composition may be inexpensive and the anti-flaking property may be improved as compared to the conventional grease composition for constant-velocity joints without using materials which have environmental burdens.

The present invention was made based on this discovery, and provides the following grease composition for constant-velocity joints and constant-velocity joint enclosing the same:

1. A grease composition for constant-velocity joints comprising:
(a) a base oil,
(b) a diurea thickener,
(c) a zinc dialkyldithiophosphate,
(d) a sulfurized molybdenum dialkyldithiocarbamate,
(e) a zinc dialkyldithiocarbamate, and
(f) a sulfur-nitrogen extreme pressure additive.
2. A constant-velocity joint, which encloses the grease composition for constant-velocity joints according to the above-described item 1.

Effect of the Invention

The grease composition of the present invention may be inexpensive and the anti-flaking property may be improved as compared to the conventional grease composition for constant-velocity joints without using materials which have environmental burdens.

BEST MODE FOR CARRYING OUT THE INVENTION

Examples of the ingredient (a), the base oil, include mineral oils such as naphthene mineral oils and paraffin mineral oils; synthetic hydrocarbon oils such as polybutene; ether type synthetic oils such as alkyl diphenyl ethers; various synthetic oils such as silicone oils and fluorinated oils; and the like.

Although these oils may be used alone or a combination of two or more of these may be mixed, the mineral oils are especially preferably used alone in terms of price.

An especially preferred base oil has a kinematic viscosity of 10 $mm^2/s$ at a temperature of 100° C.

The ingredient (b), the diurea thickener, used in the present invention may be obtained by reacting a predetermined diisocyanate and a predetermined monoamine(s).

As the ingredient (b), the diurea thickener, the compound represented by the following general formula (1) is preferred:

$$R^1NH—CO—NH—C_6H_4\text{-}p\text{-}CH_2—C_6H_4\text{-}p\text{-}NH—CO—NHR^{1'} \quad (1)$$

wherein $R^1$ and $R^{1'}$ are independently C8-C20, preferably C8-C18 alkyl, C6-C12, preferably C6-C7 aryl, or C6-C12, preferably C6-C7 cycloalkyl.

Preferable examples of diisocyanate include diphenylmethane-4,4'-diisocyanate and tolylene diisocyanate.

Examples of monoamine include aliphatic amines, aromatic amines, alycyclic amines and mixture thereof.

Specific examples of aliphatic amines include octylamines, dodecyl amines, hexadecyl amines, octadecyl amines and oleyl amines.

Specific examples of aromatic amines include aniline and p-toluidine.

Specific examples of aromatic amines include cyclohexylamine.

The ingredient (b), the aliphatic diurea thickeners, obtained by using octylamine, dodecyl amine and octadecyl amine among the above-described monoamines or mixture thereof are especially preferred.

The content of the ingredient (b), the diurea thickener, in the grease composition of the present invention may be an appropriate amount by which a required consistency is obtained, and usually, preferably 1 to 25% by mass, more preferably 2 to 20% by mass based on the whole mass of the grease composition. When the content of diurea thickener exceeds 25% by mass, the obtained grease composition may be too hard. In this case, an expected effect is hardly obtained.

The ingredient (c), the zinc dialkyldithiophosphate used for the present invention is preferably the compound represented by the following general formula (2):

$$[(R^2O)_2SP—S]_2—Zn \quad (2)$$

wherein $R^2$ is primary or secondary C1-C24 alkyl or C6-C30 aryl. $R^2$ is especially preferably C3-C8 primary or secondary alkyl.

The content of the ingredient (c) in the grease composition of the present invention is preferably 0.1 to 10% by mass, more preferably 0.1 to 5% by mass. The effect may be insufficient when the content is less than 0.1% by mass. A further promoted effect may not be observed even when the content exceeds 10% by mass.

The ingredient (d), that is the sulfurized molybdenum dialkyldithiocarbamate used for the present invention is preferably the composition represented by the following general formula (3):

$$[R^3{}_2N—CS—S]_2—Mo_2O_mS_n \quad (3)$$

wherein $R^3$ is primary or secondary C1-C24, preferably C3-C18 alkyl, m is 0 to 3, n is 1 to 4 and m+n=4.

The content of the ingredient (d) in the grease composition of the present invention is preferably 0.1 to 10% by mass, more preferably 0.1 to 5% by mass. The effect may be insufficient when the content is less than 0.1% by mass. A further promoted effect may not be observed even when the content exceeds 10% by mass.

The ingredient (e), the zinc dialkyldithiocarbamate used for the present invention is preferably the composition represented by the following general formula (4):

$$[R^4{}_2N—CS—S]_2—Zn \quad (4)$$

wherein $R^4$ is primary or secondary C1-C24 alkyl or C6-C30 aryl. $R^4$ is especially preferably C3-C8 primary or secondary alkyl.

The content of the ingredient (e) in the grease composition of the present invention is preferably 0.1 to 5% by mass, more preferably 1 to 5% by mass. The effect may be insufficient when the content is less than 0.1% by mass. A further promoted effect may not be observed even when the content exceeds 5% by mass.

The ingredient (f), the sulfur-nitrogen extreme pressure additive used for the present invention preferably has sulfur content of 5 to 20% by mass and nitrogen content of 1 to 10% by mass.

The content of the ingredient (f) in the grease composition of the present invention is preferably 0.05 to 3% by mass. The effect may be insufficient when the content is less than 0.05% by mass. A further promoted effect may not be observed even when the content exceeds 3% by mass.

The grease composition of the present invention may contain other extreme pressure additives, antioxidants, rust preventives, anticorrosives and/or the like in addition to the above-described ingredients.

The grease composition for constant-velocity joints of the present invention may be easily produced by using the ingredients (a) to (f) as essential ingredients in a desired mixing ratio and using a variety of the above-described additives as an optional ingredient. For example, a urea grease as a base grease is prepared in advance by mixing the ingredient (a) and the ingredient (b), and then the ingredients (c) to (f) are added thereto as required to produce the grease composition.

The grease composition for constant-velocity joints of the present invention, for example, preferably has a consistency of 265 to 385, more preferably 285 to 340 measured by JIS K 2220 5.3. The adjustment of such consistency may easily be performed by adjusting the amount of the above-described ingredient (b).

The grease composition for constant-velocity joint of the present invention may be employed for any kind of constant-velocity joints without any limitations. The effect of the grease composition is observed remarkably when it is used for slide-type constant-velocity joints, such as, double offset constant-velocity joint, tripod constant-velocity joint.

The effect of the grease composition is observed remarkably also when it is used for fixed-type constant-velocity joints, such as Rzeppa constant-velocity joint.

Therefore, a variety of constant-velocity joints enclosing the above-described grease compositions are also within the scope of the present invention.

EXAMPLES

Preparation of Grease Composition (a) After 250 g (1 mole) of diphenylmethane-4,4'-diisocyanate and 258 g (2 moles) of octylamine were reacted in 4000 g of a mineral oil having a kinematic viscosity of 13.2 $mm^2/s$ at a temperature of 100° C., the resulting (b), the diurea compound, was uniformly dispersed to obtain a base grease.

To this base grease, additives were added in the mixing ratios as shown in Table 1 and the resultant was adjusted to JIS consistency No. 1 grade (310 to 340) by three roll mill while (a) mineral oil were further added as required.

TABLE 1

| | | Examples | | | Comparative Examples | | | | | | |
|---|---|---|---|---|---|---|---|---|---|---|---|
| | | 1 | 2 | 3 | 1 | 2 | 3 | 4 | 5 | 6 | 7 |
| (a) | base oil | 91 | 90 | 90 | 94 | 94 | 93 | 92 | 92 | 92 | 92 |
| (b) | diurea thickener | 5 | 5 | 5 | 5 | 5 | 5 | 5 | 5 | 5 | 5 |
| (c) | ZnDTP *1 | 1 | 1 | 1 | 1 | — | 1 | — | 1 | 1 | 1 |
| (d) | MoDTC *2 | 1 | 1 | 2 | — | 1 | 1 | 1 | — | 1 | 1 |
| (e) | ZnDTC *3 | 1 | 2 | 1 | — | — | — | 1 | 1 | — | 1 |
| (f) | S—N extreme pressure agent *4 | 1 | 1 | 1 | — | — | — | 1 | 1 | 1 | — |
| SRV test | ball wear track diameter | 0.53 | 0.54 | 0.56 | 0.71 | 0.86 | 0.70 | 0.75 | 0.71 | 0.72 | 0.56 |
| | coefficient of friction | 0.058 | 0.058 | 0.059 | 0.094 | 0.073 | 0.070 | 0.078 | 0.091 | 0.075 | 0.072 |
| anti-flaking property | constant-velocity joint-A *5 | ○ | ○ | ○ | X | X | X | X | X | X | X |
| | constant-velocity joint-B *6 | ○ | ○ | ○ | X | X | X | X | X | X | X |
| | constant-velocity joint-C *7 | ○ | ○ | ○ | X | X | X | X | X | X | X |

*1 zinc dialkyldithlophosphate
*2 sulfurized molybdenum dialkyldithiocarbamate
*3 zinc dialkyldithiocarbamate
*4 heterocyclic sulfur-nitrogen compound
*5 slide-type constant-velocity joint having 8 balls as rolling elements
*6 fixed-type constant-velocity joint having 8 balls as rolling elements
*7 slide-type tripod constant-velocity joint having rollers as rolling elements <SRV Test>

With each of grease compositions in the above-described Examples 1 to 3 and Comparative Examples 1 to 7, size of the wear track of balls and coefficient of friction were read by an SRV frictional wear test to evaluate wear resistance and low frictional properties.

The test method and test conditions were based on ASTM D5707.

From a practical viewpoint, it is required that the size of the wear track is not more than 0.60 mm and the coefficient of friction is not more than 0.065.

<Anti-Flaking Property>

Each of grease compositions in the above-described Examples 1 to 3 and Comparative Examples 1 to 7 was enclosed in actual joints (slide-type constant-velocity joint and fixed-type constant-velocity joint, each having 8 balls as rolling elements, and slide-type tripod constant-velocity joint having rollers as rolling elements). A joint durability test was performed under the following conditions by using these joints to evaluate the time at the occurrence of flaking.

Measurement Condition rotation speed: 200 rpm torque: 1000 N·m angle: 6°

Evaluation Method and Evaluation Standard

Time at the occurrence of flaking at each part (outer race, inner race (or trunnion), cage, ball (or roller)) of a joint ○: not less than 500 h x: less than 500 h The results are shown in Table 1.

The grease compositions for constant-velocity joints in Examples 1 to 3 of the present invention comprising the ingredients (a) to (f) have a size of wear track of not more than 0.60 mm, coefficient of friction of not more than 0.065 and the time at the occurrence of flaking at each part of a joint of not less than 500 hours. Therefore, the grease composition of the present invention is inexpensive and has an improved anti-flaking property without using materials which have environmental burdens.

On the other hand, the size of the wear tracks with the grease compositions for constant-velocity joints in Comparative Example 1 in which the ingredients (d) to (f) are not included, Comparative Example 2 in which the ingredient (c), (e) and (f) were not included, Comparative Example 3 in which the ingredient (e) and (f) were not included, Comparative Example 4 in which the ingredient (c) is not included, Comparative Example 5 in which the ingredient (d) is not included, and Comparative Example 6 in which the ingredient (e) is not included, exceeded 0.60 mm. Any of the coefficient of friction in any of these exceeded 0.065. The time at the occurrence of flaking at each part of a joint in any of Comparative Examples 1 to 7 was less than 500 hours. Therefore, any of the grease compositions of these Comparative Examples do not have an improved anti-flaking property.

The invention claimed is:

1. A grease composition for constant-velocity joints comprising:

(a) mineral oil as a base oil, (b) a diurea thickener represented by the following formula (1):

$$R^1NH—CO—NH—C_6H_4\text{-}p\text{-}CH_2—C_6H_4\text{-}p\text{-}NH—CO—NHR^{1'} \quad (1)$$

wherein $R^1$ and $R^{1'}$ are independently C8-C20 alkyl, (c) a zinc dialkyldithiophosphate represented by the following formula (2):

$$[(R^2O)_2SP—S]_2—Zn \quad (2)$$

wherein $R^2$ is a primary or secondary C3-C8 alkyl, (d) a sulfurized molybdenum dialkyldithiocarbamate represented by the following formula (3):

$$[(R^3{}_2N—CS—S]_2—Mo_2O_mS_n \quad (3)$$

wherein $R^3$ is a primary or secondary C3-C18 alkyl, m is 0 to 3, n is 1 to 4 and m+n=4, (e) a zinc dialkyldithiocarbamate represented by the following formula (4):

$$[(R^4{}_2N—CS—S]_2—Zn \quad (3)$$

wherein $R^4$ is a primary or secondary C3-C8 alkyl, and (f) a sulfur-nitrogen extreme pressure additive other than (c) to (e) above, wherein said (b) diurea thickener is contained in an amount of 2 to 20% by mass, which makes a consistency of the grease composition within a range of 285 to 340, said (c) zinc dialkyldithiophosphate is contained in an amount of 0.1 to 5% by mass, said (d) sulfurized molybdenum dialkyldithiocarbamate is contained in an amount of 0.1 to 5% by mass, said (e) zinc dialkyldithiocarbamate is contained in an amount of 1 to 5% by mass, and wherein said (f) sulfur-nitrogen extreme pressure additive is contained in an amount of 0.05 to 3% by mass, all mass percents being based on the total amount of the composition.

2. A grease composition for constant-velocity joints according to claim 1 wherein said (b) diurea thickener is the compound represented by the formula (1), and wherein R1 and R1' are independently C8 alkyl.

3. A grease composition for constant-velocity joints according to claim 1 wherein said (f) sulfur-nitrogen extreme pressure additive has sulfur content of 5 to 20% by mass and nitrogen content of 1 to 10% by mass.

4. A constant-velocity joint, which encloses the grease composition for constant-velocity joints according to claim 1.

* * * * *